US005193556A

United States Patent [19]

Lasch et al.

[11] Patent Number: 5,193,556

[45] Date of Patent: Mar. 16, 1993

[54] METHOD OF AND APPARATUS FOR BREAKING UP BALES OF CONDENSED TOBACCO

[75] Inventors: Manfred Lasch, Hamburg; Reinhard Liebe, Börnsen, both of Fed. Rep. of Germany

[73] Assignee: Körber AG, Hamburg, Fed. Rep. of Germany

[21] Appl. No.: 733,107

[22] Filed: Jul. 19, 1991

[30] Foreign Application Priority Data

Jul. 28, 1990 [DE] Fed. Rep. of Germany ..... 4024009

[51] Int. Cl.[5] ..... A24B 7/12

[52] U.S. Cl. ..... 131/322; 131/290; 294/107; 294/126

[58] Field of Search ..... 131/290, 303, 300, 311, 131/312, 322; 294/107, 120, 126

[56] References Cited

U.S. PATENT DOCUMENTS

| | | | |
|---|---|---|---|
| 3,948,277 | 4/1976 | Wochnowski | 131/135 |
| 4,004,594 | 1/1977 | Wochnowski | 131/135 |
| 4,054,145 | 10/1977 | Berndt | 131/138 |
| 4,116,203 | 9/1978 | Wochnowski | 131/138 |
| 4,149,547 | 4/1979 | Komossa | 131/109 |
| 4,185,644 | 1/1980 | Heitmann | 131/109 |
| 4,449,540 | 5/1984 | Marshall et al. | 131/290 |
| 4,498,486 | 2/1985 | Smith | 131/300 |
| 4,600,024 | 7/1986 | Edwards | 131/327 X |
| 4,628,948 | 12/1986 | Beard | 131/327 |
| 4,733,676 | 3/1988 | Fisk | 131/290 |
| 4,932,424 | 6/1990 | Liebe | 131/304 |
| 5,025,813 | 6/1991 | Liebe et al. | 131/290 |

FOREIGN PATENT DOCUMENTS 0101271 2/1984 European Pat. Off. .

*Primary Examiner*—V Millin
*Assistant Examiner*—J. Doyle
*Attorney, Agent, or Firm*—Peter K. Kontler

[57] ABSTRACT

Bales of condensed relatively dry tobacco particles are broken up by subdividing each bale into slabs which are thereupon mechanically fragmentized, heated and moisturized with steam or steam and hot water, shredded while still heated, and thereupon subjected to one or more additional treatments. The bales are subdivided into slabs by cutting them transversely of the layers of compressed tobacco particles therein, and the heating and moisturizing steps can be carried out in a drum or in a closed tunnel of a vibratory conveyor.

32 Claims, 2 Drawing Sheets

METHOD OF AND APPARATUS FOR BREAKING UP BALES OF CONDENSED TOBACCO

BACKGROUND OF THE INVENTION

The invention relates to the treatment of tobacco in general, and more particularly to improvements in methods of and in apparatus for breaking up bales of condensed or compacted tobacco, especially relatively dry tobacco.

As used herein, the term "tobacco" is intended to denote natural, reconstituted and artificial tobacco including tobacco leaves, tobacco leaf laminae (tobacco leaves without ribs), tobacco ribs, parts of tobacco leaves, laminae and ribs, tobacco foils and/or other smokable materials.

U.S. Pat. No. 4,628,948 to Beard et al. and published European patent application No. 0 159 836 (corresponding to U.S. Pat. No. 4,733,676) propose to subdivide bales, which contain tobacco leaves or portions of tobacco leaves, into slices by cutting the bales in planes extending in parallelism with the layers of tobacco particles in the bales. Thus, the dimensions of the thus obtained slices match the dimensions of the respective bales with the sole exception of their thickness, i.e., the combined thickness of the slices which are obtained as a result of subdivision of a bale matches the thickness of the original bale. The thus obtained slices are thereupon introduced into loosening drums of the type disclosed, for example, in published European patent application No. 0 101 271 to be moisturized and, if necessary, heated in order to effect a loosening of the bonds between neighboring particles preparatory to further processing.

OBJECTS OF THE INVENTION

An object of the invention is to provide a method which renders it possible to break up bales of condensed or compacted tobacco particles in a simple, inexpensive and time-saving manner.

Another object of the invention is to provide a novel and improved method of processing bales of compacted tobacco particles all the way to and even beyond the shredding stage.

A further object of the invention is to provide a method which renders it possible to achieve substantial savings in energy for preliminary processing of tobacco.

An additional object of the invention is to provide a method which renders it possible to shred tobacco particles practically immediately or immediately following subdivision of bales of compacted tobacco into slices or slabs.

Still another object of the invention is to provide a novel method of treating tobacco particles prior to shredding.

A further object of the invention is to provide a method which renders it possible to avoid repeated moisturizing and/or repeated heating of tobacco particles which are supplied in the form of bales.

Another object of the invention is to provide a novel and improved apparatus for the practice of the above outlined method.

An additional object of the invention is to provide a novel and improved apparatus for treating bales of compacted tobacco particles preparatory to introduction of tobacco particles into a rod forming machine.

A further object of the invention is to provide the apparatus with novel and improved combinations of units which serve to treat tobacco prior to shredding.

Another object of the invention is to provide a simple and inexpensive apparatus which can break up large numbers of bales per unit of time with considerable savings in energy as compared with the energy requirements of heretofore known apparatus.

An additional object of the invention is to provide the apparatus with novel and improved means for slicing or slabbing and for further processing of bales of condensed or compacted tobacco particles.

SUMMARY OF THE INVENTION

One feature of the present invention resides in the provision of a method of separating particles of relatively dry tobacco which are condensed or compacted into a bale. The improved method comprises the steps of subdividing the bale into slices or slabs (hereinafter called slabs), and heating and moisturizing the slabs. As a rule, the bale will consist of a plurality of substantially parallel layers of tobacco particles, and the subdividing step preferably comprises severing the bale substantially transversely of (e.g., exactly at right angles to) the layers. It is presently preferred to subdivide the bale into slabs having a thickness of between 50 to 450 mm.

The method can further comprise the step of mechanically breaking up the slabs into fragments prior to the heating and moisturizing steps. The slabs and/or their fragments can be conveyed through a drum in the course of the heating and moisturizing steps.

Alternatively, the slabs and/or their fragments can be transported on a vibratory conveyor in the course of at least one of the heating and moisturizing steps. The heating and/or the moisturizing step can include contacting the slabs and/or their fragments with steam and/or with steam and hot water during transport of slabs and/or their fragments by the vibratory conveyor. The transporting step can include moving the slabs and/or their fragments in a closed or nearly closed tunnel of the vibratory conveyor. The tunnel is preferably of the type having bottom, top and lateral walls (sidewalls), and the contacting step can include admitting steam through at least one wall of the tunnel.

The heating and/or the moisturizing step can include directing against the slabs and/or against their fragments steam from a plurality of different directions. Such directing step can include forming a plurality of jets of steam including divergent and/or convergent neighboring jets of steam.

When the moisturizing step is completed, the relative moisture content of tobacco particles is preferably between 11 and 30 percent, particularly between 13 and 15 percent (for example, approximately 14 percent).

When the heating step is completed, the temperature of tobacco particles is preferably between 60° and 100° C., particularly between 90° and 100° C.

The method can further comprise the step of comminuting the particles of tobacco upon completion of the heating and moisturizing steps; this can involve shredding the particles of tobacco immediately following the heating step so that the particles are still heated in the course of the shredding step.

It is further within the purview of the invention to subject the heated, moisturized and comminuted particles to one or more additional treatments. For example, an additional treatment can involve heating and/or moisturizing the comminuted tobacco particles, preferably immediately following the comminuting step.

Another feature of the present invention resides in the provision of an apparatus for separating particles of relatively dry tobacco which are condensed into a bale. The apparatus comprises means for subdividing the bale into slabs, and conditioning means including means for heating and moisturizing the slabs. If the bale is of the type having a plurality of substantially parallel layers of tobacco particles, the subdividing means preferably comprises means for severing the bale substantially transversely of the layers. The subdividing means can include means for cutting up the bale into slabs having a thickness of between 50 and 450 mm, normally between 80 and 120 mm.

The apparatus can further comprise means for mechanically breaking up the slabs into fragments, and the conditioning means then includes means for heating and moisturizing the thus obtained fragments.

The conditioning means can comprise a drum or a vibratory conveyor for the slabs and/or their fragments. The vibratory conveyor can be of the type having a substantially closed tunnel with a bottom wall, a top wall and sidewalls. At least one of these walls can be provided with a plurality of channels, and at least one of the heating and moisturizing means can comprise means for admitting into the tunnel steam or steam and water through at least some channels of the at least one wall of the tunnel.

The moisturizing and/or heating means is preferably designed to admit into the tunnel of the vibratory conveyor jets of steam from a plurality of different directions.

The moisturizing means can be designed to impart to tobacco particles a moisture content of between 11 and 30 percent, preferably between 13 and 15 percent (for example, approximately 14 percent).

The heating means can include means for imparting to tobacco particles a temperature of between 60° and 100° C., preferably between 90° and 100° C.

The apparatus can further comprise means for comminuting tobacco particles subsequent to heating and moisturizing of such particles by the conditioning means. The comminuting means can include means for shredding heated tobacco particles, i.e., the shredding can take place immediately following heating of tobacco particles.

Still further, the apparatus can comprise means for treating (e.g., drying or moisturizing) comminuted tobacco particles.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
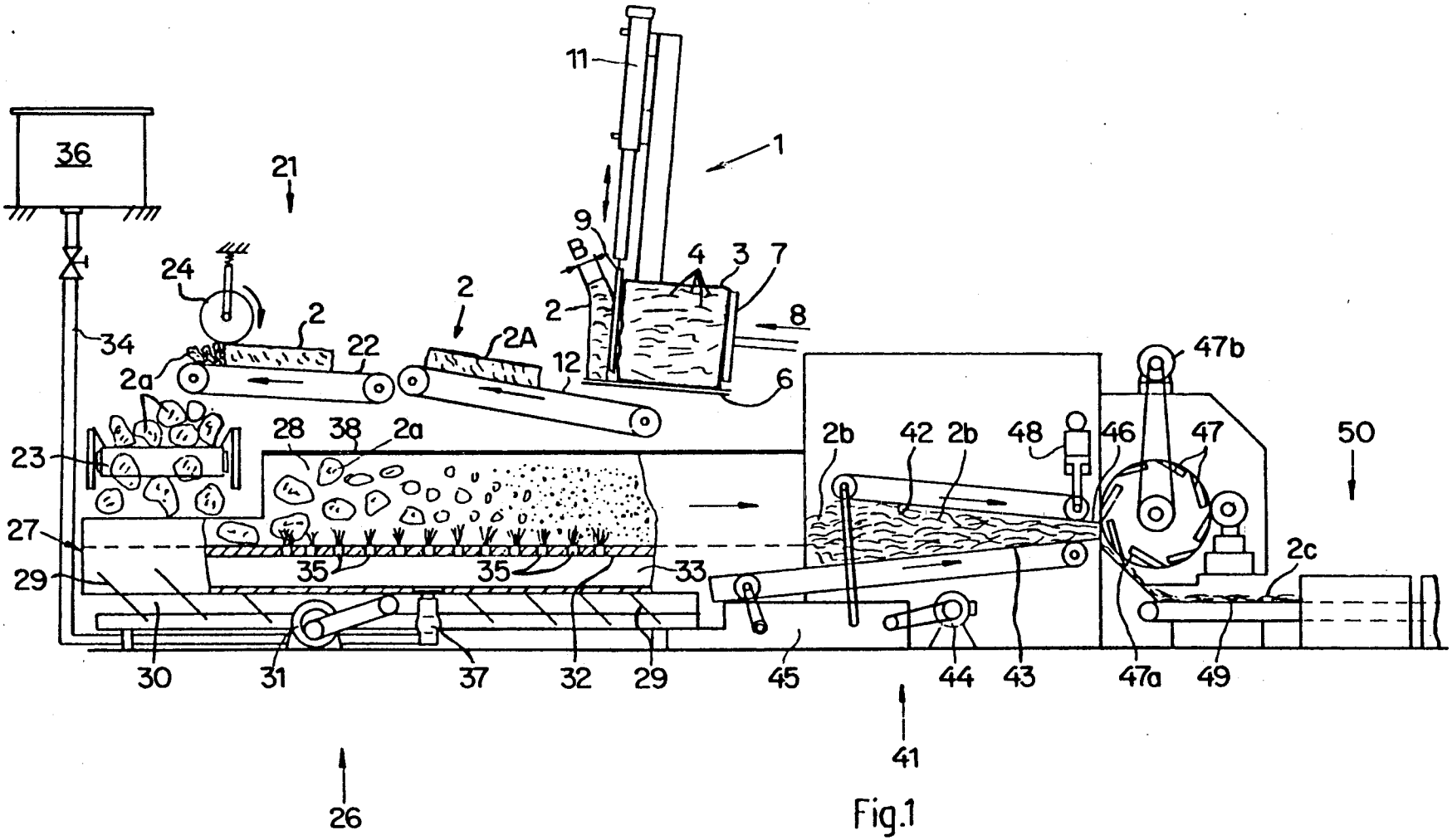
FIG. 1 is a schematic partly elevational and partly sectional view of an apparatus which can be utilized for the practice of the method of the present invention.

FIG. 1 shows a portion of an apparatus which is designed for treatment of successive bales 3 of compacted or condensed tobacco particles 2*b*. Each bale 3 is stratified, i.e., it comprises a plurality of substantially parallel layers or strata 4 of relatively dry tobacco particles 2*b*. The layers 4 are substantially horizontal in that bale 3 which is in the process of being subdivided into slices or slabs 2, and successively formed slabs 2 are tilted so that they lie flat on the upper reach of an endless flexible belt or chain conveyor 12. The layers 4 in the slabs 2 on the conveyor 12 and on a further endless flexible conveyor 22 are substantially vertical.

The subdividing unit 1 of the apparatus which is shown in FIG. 1 receives successive bales 3 from a suitable source, not shown, and the bale which comes to rest on a substantially horizontal platform 6 of the subdividing unit 1 is repeatedly severed by a guillotine type knife 9 which is movable up and down by a suitable drive 11 (e.g., a drive including a hydraulic or pneumatic double-acting cylinder and piston unit) to sever the bale 3 on the platform 6 substantially at right angles to the planes of the respective layers 4. A pusher 7 is provided to move the bale 3 on the platform 6 in the direction of arrow 8 when the knife 9 is raised so that the bale can be advanced by a distance corresponding to the thickness B of a slab 2 before the knife 9 is caused to descend and to form a fresh slab. The same operation is repeated again and again until the bale on the platform 6 is consumed, and the platform is then ready to receive a fresh bale while the knife 9 is maintained in the raised position and the pusher 7 is maintained in a fully retracted position to provide room for a fresh bale 3 on the platform 6. The mechanism which is used to move the pusher 7 incrementally in the direction of arrow 8 (through distances corresponding to the thickness B of a slab 2), and to retract the pusher 7 when the subdivision of a bale is completed, can be of any known design (for example, a fluid-operated double acting cylinder and piston unit which is preferably adjustable to select the thickness B of the slabs 2). It is presently preferred to subdivide successive bales 3 into slabs 2 having a thickness of between 50 and 450 mm, e.g., between 80 and 120 mm. The particles 2*b* which form the layers 4 of the bales 3 can constitute tobacco leaves or tobacco leaf laminae, and such particles can also include a number of whole or comminuted tobacco ribs.

The operation of the drive 11 for the knife 9 is synchronized with the operation of the means for reciprocating the pusher 7 in such a way that the pusher is moved in the direction of arrow 8 when the knife 9 is located at a level above the bale 3 on the platform 6, and that the pusher is held against movement in the direction of arrow 8 while the knife 9 is in the process of making a slab 2.

A freshly formed slab 2 can be automatically tilted in a counterclockwise direction (as viewed in FIG. 1) in order to descend onto the upper reach of the endless flexible conveyor 12 which transports successive slabs onto the upper reach of the endless flexible conveyor 22. The conveyor 22 forms part of or cooperates with a mechanical breaking up device 21 including a roller or wheel 24 which is driven in a clockwise direction (as viewed in FIG. 1) at a peripheral speed exceeding the speed of the conveyor 22. This ensures that the wheel 24 can break up each slab 2 into a plurality of smaller portions or fragments 2a. The breaking up action of the mechanical device 21 is facilitated by the fact that the knife 9 severs successive bales 3 at right angles to the layers 4 of tobacco particles 2b in the bales. Thus, the layers 4 are located in substantially vertical planes during travel with the upper reach of the conveyor 22, and this enables the wheel 24 to "peel" successive fragments 2a off the slab 2 on the conveyor 22. Each fragment 2a can constitute a portion of a single layer 4 or portions of two or more neighboring (still coherent) layers 4. In fact, once a slab 2 has been caused to advance onto the upper stretch or reach of the conveyor 22, it is likely to exhibit at least some tendency to come apart and to form fragments 2a, for example, due to the difference of inclinations of the upper reaches of the conveyors 12 and 22. Such tendency of the slabs 2 to break in the planes of some or all of the layers 4 facilitates the task of the wheel 24 in ensuring that the left-hand end of the conveyor 22 discharges a stream or series of relatively small fragments 2a which descend onto the upper reach of a further endless belt or chain conveyor 23 serving to advance the fragments 2a in a direction at right angles to the plane of FIG. 1.

The peripheral speed of the roller 24 in the breaking up device 21 can greatly exceed the speed of the conveyor 22. This conveyor can have an elastic (e.g., stretchable) endless flexible element of steel or the like which is trained over pulleys or sprocket wheels.

The wheel 24 can be replaced by a belt or chain conveyor which is driven at a speed exceeding that of the conveyor 22.

The conveyor 23 delivers the fragments 2a of slabs 2 into a conditioning unit 26 wherein the fragments are acted upon by moisture and/or heat prior to reaching a comminuting machine 41. The conditioning unit 26 of FIG. 1 comprises a closed tunnel-shaped vibratory conveyor 27, e.g., a conveyor of the type known in the tobacco processing industry as HT which is made and distributed by the assignee of the present application. The actual tunnel 28 of the vibratory conveyor 27 is mounted on leaf springs 29 and is vibrated relative to a stationary base 30 by one or more driven rotary eccentrics 31.

The bottom wall 32 of the tunnel 28 can be made of sheet metal and is formed with a plurality of suitably distributed and oriented openings or channels 35 for admission of steam into the interior of the tunnel 28, i.e., into contact with fragments 2a of the slabs 2. The channels 35 receive jets of steam from a steam chamber 33 which is disposed beneath the bottom wall 32 and receives steam from a saturated or superheated steam generator 36 through a conduit 34. The conduit 34 includes an elastically deformable portion 37 so that its discharge end can vibrate with the chamber 33 while the major portion of the conduit 34 remains stationary.

The jets of hot and normally damp steam which are admitted into the tunnel 28 of the vibratory conveyor 27 through the channels 35 of the bottom wall 32 impinge upon the relatively large exposed surfaces of the fragments 2a and initiate and promote loosening of tobacco particles 2b which together form the individual fragments. The loosening and separating action of the jets of steam issuing from the channels 35 is highly effective because steam is free to penetrate into the relatively large exposed surfaces of the fragments 2a, particularly into those surfaces which constitute portions of the freshly cut surfaces 2A of successively formed slabs 2, i.e., of those surfaces which are formed by the knife 9 at right angles or substantially at right angles to the planes of the layers 4. Such mode of treating the fragments 2a of slabs 2 with saturated steam, preferably at a pressure of 3 to 10 bar above atmospheric pressure, has been found to result in gentle treatment of tobacco particles 2b and in rapid and reliable separation or loosening of the particles 2b in the tunnel 28 so that the particles can be said to form a homogeneous mass of discrete particles which are ready to be admitted into the comminuting machine 50 even before the heating effect of steam upon the particles 2b disappears.

The loosening and separating action of steam which is supplied by the steam generator 36 only via steam chamber 33 and/or through one or more additional chambers can be enhanced still further by providing the sidewalls 39, 40 and/or the top wall 38 (FIG. 2) of the tunnel 28 with additional openings or channels 35 for admission of steam into the space for the fragments 2a.

Still further, the loosening and separating action in the tunnel 28 can be enhanced by increasing the moisture content of the fragments 2a, e.g., by spraying hot water or another liquid in a manner as known from the aforediscussed HT units of the assignee of the present application. If the particles 2b of the fragments 2a are to be subjected to a less intensive moisturizing action, the steam generator 36 can be modified to constitute, or can be replaced with, a source which supplies dry steam in lieu of saturated steam.

The illustrated conditioning unit can be replaced with a conditioning unit of the type described and shown in the aforementioned published European patent application No. 0 101 271 and U.S. Pat. No. 4,733,676. These publications describe and show a drum-shaped conditioning unit wherein the fragments of slabs coming from the conveyors 22, 23 can be heated and moisturized instead of in the tunnel 28 of the vibratory conveyor 27. This, too, results in highly satisfactory loosening and separation of tobacco particles which constitute the individual fragments 2a.

The separated particles 2b of loosened fragments 2a enter the convergent passage between the upper and lower endless chains 42, 43 of the comminuting machine 41 which, in the illustrated embodiment, is a shredder of the type described and shown, for example, in commonly owned U.S. Pat. No. 4,149,547 to Komossa et al. As mentioned above, the machine 41 preferably receives tobacco particles prior to cooling of the particles, i.e., the machine 41 can be placed immediately downstream of the discharge end of the vibrating tunnel 28. The convergent chains 42, 43 of the machine 41 convert the loosened and separated particles 2b into a so-called cake which advances into and through a mouthpiece 46 and its leader is severed by successive shredding knives 47 mounted on a rotary holder 47a which is driven by a variable-speed motor 47b. The right-hand end of the upper chain 42 is biased toward the right-hand end of the lower chain 43 by a fluid-operated (e.g., hydraulic) pressure generating device 48 which ensures that the cake is adequately compacted during passage into and beyond the mouthpiece 46. The chains 42, 43 are driven by a motor 44 through a variable speed transmission 45.

A belt conveyor 49 is provided to intercept and transport away the shreds 2c which are formed by the knives 47. The conveyor 49 delivers tobacco shreds 2c to one or more additional treating or processing stations one of which is shown at 50.

The illustrated processing station 50 can include a moisturizing unit which can be a replica of the conditioning unit 26 or an equivalent thereof (such as the aforediscussed drum-shaped conditioning unit). The moisturizing unit can increase the moisture content of the shreds 2c for the purpose of expansion (e.g., puffing) and/or for other purposes. Moisturizing can involve contacting the shreds 2c with steam. An additional advantage of such treatment with steam downstream of the comminuting machine 41 is that it results in separation of shreds 2c which continue to adhere to each other on the conveyor 49. The tendency of some shreds 2c to adhere to each other can be attributable to incomplete breaking up or loosening or separation of certain fragments 2a in the tunnel 28 ahead of the comminuting apparatus 41.

It is further within the purview of the invention to equip the additional station 50 with a tobacco drier if the moisture content of tobacco shreds 2c is too high for immediate introduction into the distributor or hopper of a rod making machine.

The moisturizing unit for still hot but relatively dry tobacco shreds 2c which issue from the comminuting machine 41 need not necessarily be a replica of the conditioning unit 26. For example, the shreds 2c can be moisturized while still hot (i.e., immediately after they leave the machine 41) in a moisturizing drum of the type disclosed in commonly owned U.S. Pat. No. 4,054,145 to Berndt et al. or in commonly owned U.S. Pat. No. 3,948,277 to Wochnowski et al. In accordance with a presently preferred embodiment, shredded tobacco particles 2c can be treated with steam for the purpose of moisturizing and/or heating in a so-called steaming tunnel, e.g., a tunnel of the type described and shown in commonly owned U.S. Pat. No. 4,004,594 to Wochnowski or in published British patent application No. 2 138 666. In order to minimize the energy requirements, the moisture content of tobacco shreds can be increased only to that which is necessary for further processing of the shreds at room temperature, particularly in a cigarette rod making machine. Of course, the moisture content can be much higher (e.g., at least slightly above 20 percent) if the manufacturer of cigarettes or other rod-shaped smokers' articles wishes to increase the filling power; this involves raising the moisture content above and thereupon lowering the moisture content to that which is required or desirable for further processing. As mentioned above, moisturizing of tobacco shreds 2c preferably takes place while they are still warm, e.g., immediately downstream of the machine 41.

Another treatment which follows the shredding operation at 41 can include contacting the shreds 2c with liquid aromatic or flavoring substances (such as casing and/or top flavour).

If the tobacco which is shredded is Burley, the after-treatment of shreds 2c can involve heating to a temperature which is necessary for expulsion of ammonia.

The moisture content of tobacco particles 2b which issue from the tunnel 28 can be as low as 11 percent or as high as 30 percent. Relatively low moisture content of particles 2b is desirable and advantageous if the particles 2b are shredded immediately after they issue from the tunnel 28 (as actually shown in the drawing), i.e., if the shredding step is carried out while the particles are still hot or heated. Shredding of relatively hot tobacco particles can be carried out while the moisture content of such particles is lower than that of cold tobacco particles which are about to be shredded. Relatively high moisture content of tobacco particles 2b is desirable and advantageous if the particles 2b are permitted to dissipate heat subsequent to leaving the tunnel 28, e.g., if the comminuting machine 41 is remote from the conditioning unit 26.

It has been found that the shredding of tobacco particles 2b can be carried out in a highly satisfactory manner if the temperature of such particles is not less than 50° C., i.e., if the machine 41 is sufficiently close to the unit 26 to prevent premature cooling of freshly loosened, heated and moisturized particles 2b or if the mode of transporting the particles 2b from the tunnel 28 to the comminuting machine 41 is such that the temperature of tobacco particles is not permitted to drop to or below 50° C. Tobacco particles 2b which are introduced into the comminuting machine 41 at a temperature of not appreciably less than 50° C. are sufficiently supple to undergo a highly satisfactory shredding action, even if their moisture content is not very high. For example, the moisture content of tobacco particles 2b in the comminuting machine 41 need not exceed, or need not appreciably exceed, the range of 13 to 15 percent which is normally required for further processing of shredded tobacco. Shredding of particles 2b having a relatively low moisture content (e.g., between or only slightly above 13 and 15 percent) is desirable and advantageous because one can dispense with the step of drying the tobacco shreds 2c. Such drying is necessary if tobacco particles 2b which are being shredded have a moisture content of 20 percent for tobacco leaf laminae and 30 percent for tobacco ribs. These are the moisture contents which are considered necessary for proper shredding of tobacco leaf laminae and tobacco ribs, respectively.

In accordance with a further modification, the apparatus of FIG. 1 can be equipped with a chute or trough for admission of additional tobacco particles between the tunnel 28 of the vibratory conveyor 27 and the comminuting machine 41. The chute or trough can be of the type known as SRB which is made and sold by the assignee of the present application and is described and shown, for example, on page 277 of the July 1980 issue (publication No. 19501) of the monthly entitled Research Disclosure.

Figure 2:
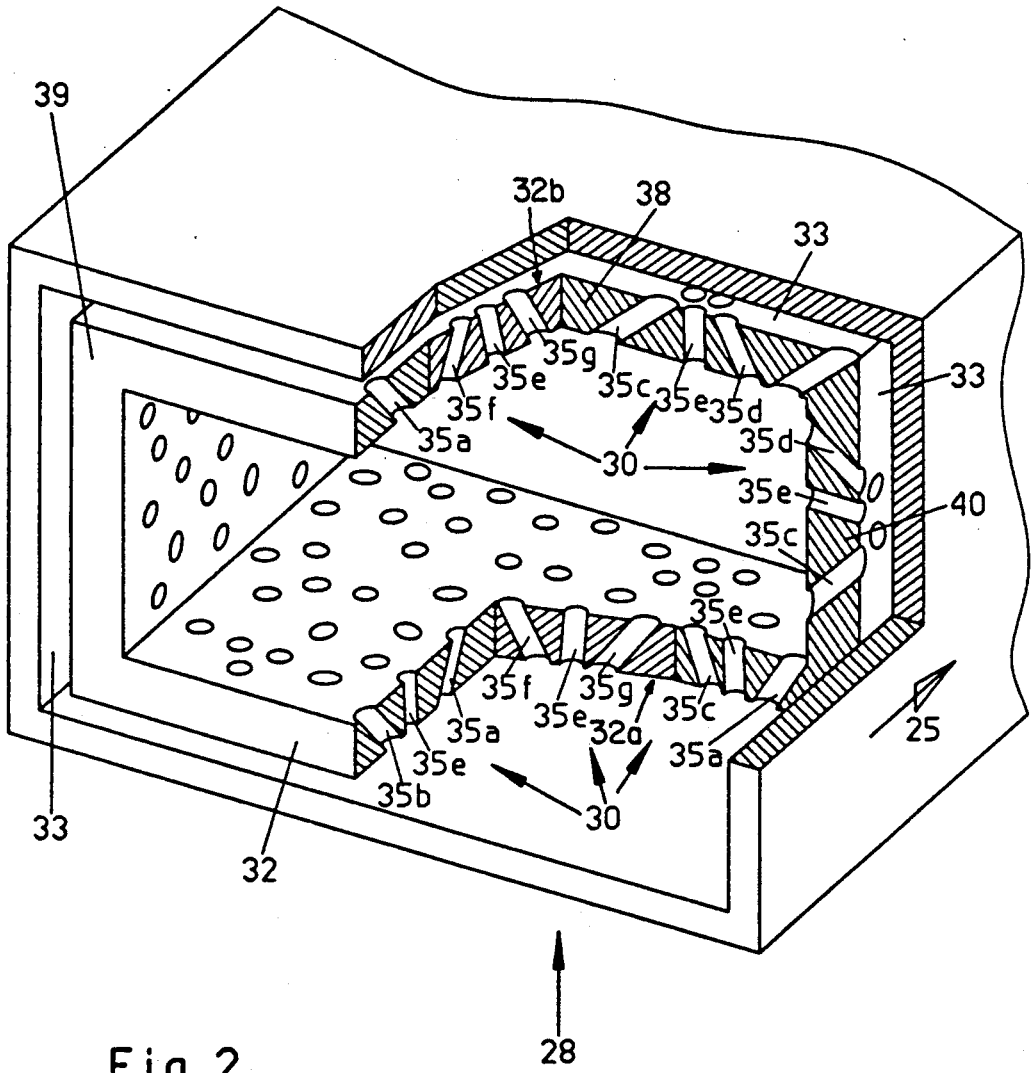
FIG. 2 is an enlarged fragmentary perspective view of a portion of conditioning means for use in the apparatus of FIG. 1.

FIG. 2 is a greatly enlarged view of a portion of the tunnel 28 of the vibratory conveyor 27 which is shown in FIG. 1. The bottom wall 32 of this tunnel has arrays or groups 30 of mutually inclined and/or parallel channels 35a to 35g. As explained above, the channels serve to admit jets of steam which impinge upon the exposed surfaces of the fragments 2a and initiate and promote the breaking up of such fragments into individual or discrete tobacco particles 2b, e.g., tobacco leaves and/or tobacco leaf laminae. The arrays 30 include neighboring divergent and/or convergent channels; this is desirable and advantageous because it ensures that each and every exposed surface or facet of each fragment 2a is more likely to be contacted by one or more jets of steam which is supplied by the chamber 33.

The conditioning tunnel is cut at right angles to the direction of transport as indicated by arrow 25a with the exception of the cut surfaces 32a and 32b which are offset at an angle of 15° to the vertical to the direction of transport, respectively the direction of transport of tobacco.

For the sake of simplicity, the bottom wall 32 which is shown in FIG. 2 is provided with only three different arrays 30 of channels 35. In actual practice, the number of different arrays can be much greater to further ensure highly predictable and uniform contact of steam with all exposed surfaces or facets of the fragments 2a in the tunnel 28. The advantages of providing the bottom wall of a tobacco conveying tunnel with mutually inclined channels for admission of steam and/or another treating medium are described and shown in commonly owned U.S. Pat. No. 4,943,424 to Liebe et al. The mutual inclination of channels can be attributable to undulations of the bottom wall (as shown for examle, in FIGS. 2 and 4 of U.S. Pat. No. 4,932,424) and/or to the provision of suitably inclined nozzles and/or beads in the bottom wall 32. It has been found that channels which exhibit a rather pronounced inclination relative to the general plane of the bottom wall 32 (namely channels which make a small angle with the conveying surface of the channel) are of particular importance for proper contact between the jets of steam and certain relatively small surfaces of fragments 2a in the tunnel 28. Thus, even relatively small fragments having separation surfaces which are substantially horizontal during travel through the tunnel 28 are highly likely to be contacted with jets of steam issuing from the chamber 33.

The channels 35a direct jets of steam with a component in, and the channels 35b direct jets of steam with a component counter to, the direction of arrow 25 (direction of transport of fragments 2a in the tunnel 28). The channels 35e direct jets of steam substantially or exactly at right angles to the plane of the bottom wall 32, and the channels 35c, 35d direct jets of steam substantially transversely of the direction of the arrow 25. The channels 35f and 35g serve to direct jets of steam in such a way that each of these jets has a component of propagation in the direction of arrow 25 as well as a component of propagation at right angles to the direction of arrow 25. The just described functions of the channels 35a to 35g have been found to ensure highly satisfactory and predictable contact of jets of steam with the fragments 2a which are in the process of advancing along the vibrating bottom wall 32 in a direction from the conveyor 23 toward the comminuting machine 41.

FIG. 2 further shows that various patterns or arrays 30 of channels 35a to 35g can also be provided in one or both sidewalls 39, 40 and in the top wall 38 of the tunnel 28. If desired, the top wall 38 can be provided only with channels 35e, i.e., with channels extending exactly or substantially at right angles to the plane of the top wall.

It is to be understood that the number, orientation and/or distribution of channels in the wall 32, 39, 40 and/or 38 of the tunnel 28 can depart from the illustrated number, orientation and/or distribution of channels without departing from the spirit of the invention. Furthermore, it is not necessary that the entire wall 32, 38, 39 and/or 40 be provided with channels.

An important advantage of the improved apparatus is that its sapce requirements are surprisingly small. Moreover, the particles of tobacco are treated gently and the energy requirements of the apparatus are low. Slicing of tobacco bales 3 substantially or exactly at right angles to their layers 4 facilitates the immediately following breaking up into fragments, with or without resorting to preferably mechanical breaking up means, i.e., the mechanical device 21 or an equivalent thereof is optional.

Another important advantage of the improved method and apparatus is that the slabs 2 are broken up into fragments 2a and the fragments are broken up or separated into discrete tobacco particles 2b with a high degree of reliability and predictability. This is due to the presently preferred treatment in the tunnel 28 wherein the fragments 2a are preferably acted upon by jets of steam which are directed against the fragments from a number of different directions, preferably not only through channels 35 or nozzles in the bottom wall 32 but also through channels 35 or nozzles in at least one of the walls 38, 39 and 40. The jets of steam, with or without sprays of hot water or another liquid, can contact all sides of the relatively small fragments 2a to ensure penetration of steam and/or hot water into each and every fragment 2a from a number of directions and to a depth which is needed to ensure predictable separation of particles 2b which were held together in the form of fragments 2a. As mentioned above, water and/or steam which penetrates into the surfaces 2A is particularly effective to effect rapid and reliable loosening because such penetration takes place between the layers 4 of particles 2b which form the slabs 2 and their fragments 2a.

It has been found that penetration of water and/or steam from a number of different directions contributes significantly to the speed and reliability of the loosening action. Admission of water and/or steam from a number of different directions ensures reliable contact of water and/or steam with all sides of fragments 2a which are agitated in and advance through the tunnel 28 in a direction from the conveyor 23 toward the comminuting machine 41; such thorough contact between the agitated fragments 2a and the jets or sprays of water and/or steam is ensured irrespective of the orientation of fragments at the time they are actually contacted by water and/or steam because the jets or sprays are directed into the tunnel from a number of different directions regardless of whether the admission of water and/or steam takes place through a single wall (e.g., the bottom wall 32) or through two or more walls of the tunnel 28. If the particles 2b are to be heated but their moisture content is to remain unchanged, the steam generator 36 is designed or set up to supply superheated (i.e., dry) steam. Saturated steam is supplied if the moisture content of the particles 2a is to be increased ahead of the comminuting machine 41. The latter preferably receives tobacco particles 2b which can be slightly cooled (e.g., such particles can reach the chains 42, 43 at a temperature of between 50° and 70° C.) but is still rather hot and has a moisture content between or only slightly above 13 and 15 percent (this is the moisture content which is normally desirable for further processing of tobacco shreds). This entails substantial savings in energy when compared with heretofore known treatments which involve increasing the moisture content to between 20 and 30 percent for the purpose of shredding and thereupon drying the shreds to reduce their moisture content to between 13 and 15 percent preparatory to further processing, e.g., for admission into the distributor or hopper of a cigarette rod making machine. Repeated moisturizing and drying consumes much energy and affects the quality of tobacco.

If an additional treatment (downstream of the comminuting machine 41) is necessary or desirable, it can be selected in such a way that it entails separation of coherent shreds 2c, i.e., of shreds which tend to adhere to each other due to admission of incompletely loosened or broken up fragments 2a in the tunnel 28. The mere fact that the particles 2b and remnants (if any) of fragments 2a which enter the machine 41 are still heated contributes to ready separation of shreds 2c. Additional highly reliable separation of such shreds can be achieved if the station 50 accommodates a unit which treats the shreds 2c with steam.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of separating particles of relatively dry tobacco which are condensed into a bale having a plurality of substantially parallel layers of particles, comprising the steps of subdividing the bale into slabs including severing the bale substantially transversely of the layers; mechanically breaking up the slabs into fragments of coherent tobacco particles; heating and moisturizing the fragments; and transporting the fragments on a vibratory conveyor in the course of at least one of said heating and moisturizing steps to thereby separate the tobacco particles of the fragments from each other.

2. The method of claim 1, wherein said subdividing step includes slicing the bale into slabs having a thickness of 50 to 450 mm.

3. The method of claim 1, wherein at least one of said heating and moisturizing steps includes contacting the fragments on the vibratory conveyor with steam and/or with steam and hot water.

4. The method of claim 3, wherein said transporting step includes moving the fragments in a closed tunnel of the vibratory conveyor.

5. The method of claim 3, wherein said transporting step includes moving the fragments in a substantially closed tunnel having bottom-, side- and top walls, said contacting step including admitting steam through at least one wall of the tunnel.

6. The method of claim 1, wherein said heating and moisturizing steps comprising contacting the fragments with steam and/or with steam and hot water and said transporting step includes moving the fragments in a closed tunnel of the vibratory conveyor.

7. The method of claim 1, wherein at least one of said heating and moisturizing steps comprises directing against the fragments steam from a plurality of different directions.

8. The method of claim 7, wherein said directing step includes forming a plurality of jets of steam including divergent neighboring jets of steam.

9. The method of claim 1, wherein the relative moisture content of tobacco particles upon completion of said moisturizing step is between 11 and 20 percent.

10. The method of claim 9, wherein the relative moisture content is between 13 and 15 percent.

11. The method of claim 10, wherein the relative moisture content is approximately 14 percent.

12. The method of claim 1, wherein the temperature of tobacco particles upon completion of said heating step is between 60° and 100° C.

13. The method of claim 12, wherein the temperature is between 90° and 100° C.

14. A method of separating particles of relatively dry tobacco which are condensed into a bale, comprising the steps of subdividing the bale into slabs; mechanically breaking up the slabs into fragments of coherent tobacco particles; heating and moisturizing the fragments; transporting the fragments on a vibratory conveyor in the course of at least one of said heating and moisturizing steps to thereby separate the tobacco particles of the fragments from each other; and comminuting the tobacco particles upon completion of said heating and moisturizing steps.

15. The method of claim 14, wherein said comminuting step includes shredding the tobacco particles immediately following said heating step so that the particles are still heated in the course of said shredding step.

16. The method of claim 14, further comprising the additional step of heating and/or moisturizing the comminuted tobacco particles.

17. The method of claim 16, wherein said additional step is carried out immediately following said comminuting step.

18. Apparatus for separating particles of relatively dry tobacco which are condensed into a bale having a plurality of substantially parallel layers of particles, comprising means for subdividing the bale into slabs including means for severing the bale substantially transversely of the layers; means for mechanically breaking up the slabs into fragments of coherent tobacco particles; and conditioning means including means for heating and moisturizing the fragments and a vibratory conveyor having means for transporting the fragments which are being heated and moisturized to thereby separate the tobacco particles of the fragments from each other.

19. The apparatus of claim 18, wherein said subdividing means comprises means for cutting up the bale into slabs having a thickness of between 50 and 450 mm.

20. The apparatus of claim 18 wherein said vibratory conveyor comprises a tunnel.

21. The apparatus of claim 20, wherein said tunnel includes a bottom wall having a plurality of channels and at least one of said heating and moisturizing means comprises means for admitting into said tunnel steam through at least some of said channels.

22. The apparatus of claim 20, wherein at least one of said heating and moisturizing means comprises means for admitting into said tunnel jets of steam from a plurality of different directions.

23. The apparatus of claim 18, wherein said moisturizing means includes means for imparting to tobacco particles a moisture content of between 11 and 20 percent.

24. The apparatus of claim 23, wherein the moisture content is between 13 and 15 percent.

25. The apparatus of claim 23, wherein the moisture content is approximately 14 percent.

26. The apparatus of claim 18, wherein said heating means includes means for imparting to tobacco particles a temperature of between 60° and 100° C.

27. The apparatus of claim 26, wherein the temperature is between 90 and 100 percent.

28. Apparatus for separating particles of relatively dry tobacco which are condensed into a bale, comprising means or subdividing the bale into slabs; means for mechanically breaking up the slabs into fragments of coherent tobacco particles; and conditioning means including means for heating and moisturizing the fragments and a vibratory conveyor having means for transporting the fragments which are being heated and moisturized to thereby separate the tobacco particles of the fragments from each other, said vibratory conveyor comprising a tunnel and said tunnel including sidewalls, at least one of said sidewalls having a plurality of channels and at least one of said heating and moisturizing means comprising means for admitting into said tunnel steam through at least some of said channels.

29. Apparatus for separating particles of relatively dry tobacco which are condensed into a bale, comprising means for subdividing the bale into slabs; means for mechanically breaking up the slabs into fragments of coherent tobacco particles; and conditioning means including means for heating and moisturizing the fragments and a vibratory conveyor having means for transporting the fragments which are being heated and moisturized to thereby separate the tobacco particles of the fragments from each other, said vibratory conveyor comprising a tunnel and said tunnel including a top wall having a plurality of channels, at least one of said heating and moisturizing means comprising means for admitting into said tunnel steam through at least some of said channels.

30. Apparatus for separating particles of relatively dry tobacco which are condensed into a bale, comprising means for subdividing the bale into slabs; means for mechanically breaking up the slabs into fragments of coherent tobacco particles; conditioning means including means for heating and moisturizing the fragments and a vibratory conveyor having means for transporting the fragments which are being heated and moisturized to thereby separate the tobacco particles of the fragments from each other; and means for comminuting tobacco particles subsequent to heating and moisturizing of such particles by said conditioning means.

31. The apparatus of claim 30, wherein said comminuting means comprises means for shredding heated tobacco particles.

32. The apparatus of claim 50, further comprising means for treating comminuted tobacco particles.

* * * * *